US009224265B2

(12) United States Patent
Caputo

(10) Patent No.: US 9,224,265 B2
(45) Date of Patent: Dec. 29, 2015

(54) GAMING SYSTEM AND METHOD FOR PROVIDING AN OFFER AND ACCEPTANCE GAME

(75) Inventor: Scott A. Caputo, Santa Clara, CA (US)

(73) Assignee: IGT, Las Vegas, NV (US)

( * ) Notice: Subject to any disclaimer, the term of this patent is extended or adjusted under 35 U.S.C. 154(b) by 207 days.

(21) Appl. No.: 13/565,346

(22) Filed: Aug. 2, 2012

(65) Prior Publication Data

US 2014/0038698 A1 Feb. 6, 2014

(51) Int. Cl.
*A63F 9/24* (2006.01)
*G07F 17/32* (2006.01)

(52) U.S. Cl.
CPC ..... *G07F 17/3255* (2013.01); *G07F 17/3258* (2013.01); *G07F 17/3262* (2013.01)

(58) Field of Classification Search
CPC ..... G07F 17/3262; A63F 9/24
USPC ..... 463/20, 16–19
See application file for complete search history.

(56) References Cited

U.S. PATENT DOCUMENTS

| | | | |
|---|---|---|---|
| 3,559,993 | A | 2/1971 | Thomas |
| 3,770,277 | A | 11/1973 | Cass |
| 4,363,489 | A | 12/1982 | Chodak et al. |
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,324,041 | A | 6/1994 | Boylan et al. |
| 5,342,047 | A | 8/1994 | Heidel et al. |
| 5,456,465 | A | 10/1995 | Durham |
| 5,511,781 | A | 4/1996 | Wood et al. |
| 5,524,888 | A | 6/1996 | Heidel |
| 5,536,016 | A | 7/1996 | Thompson |
| 5,542,669 | A | 8/1996 | Charron et al. |

(Continued)

FOREIGN PATENT DOCUMENTS

| | | |
|---|---|---|
| EP | 0 874 337 | 10/1998 |
| EP | 0 926 645 | 6/1999 |

(Continued)

OTHER PUBLICATIONS

San Marco Player Aid Sheet, available prior to Aug. 2, 2012.

(Continued)

*Primary Examiner* — James S McClellan
*Assistant Examiner* — Syvila Weatherford
(74) *Attorney, Agent, or Firm* — Neal, Gerber & Eisenberg LLP

(57) ABSTRACT

A gaming system for providing a multiple round offer and acceptance game with a multi-component offers. In various embodiments, the offer and acceptance game is a multi-round offer and acceptance game, wherein the player's decisions during one or more rounds of the offer and acceptance game determine, at least in part, whether the player will play or participate in each of the subsequent rounds of the offer and acceptance game. In these embodiments, for each played round of the offer and acceptance game, the gaming system enables the player to accept or reject one or more different offers which have different award values and also contribute different amounts toward terminating the play of the offer and acceptance game.

32 Claims, 11 Drawing Sheets

(56) References Cited

U.S. PATENT DOCUMENTS 5,560,603 A 10/1996 Seelig et al.
5,611,535 A 3/1997 Tiberio
5,711,525 A 1/1998 Breeding
5,769,716 A 6/1998 Saffari et al.
5,772,509 A 6/1998 Weiss
5,775,692 A 7/1998 Walls et al.
5,788,573 A 8/1998 Baerlocher et al.
5,823,874 A 10/1998 Adams
5,833,536 A 11/1998 Davids et al.
5,833,538 A 11/1998 Weiss
5,848,932 A 12/1998 Adams
5,851,148 A 12/1998 Brune et al.
5,855,514 A 1/1999 Kamille
5,873,781 A 2/1999 Keane
5,882,261 A 3/1999 Adams
5,890,963 A 4/1999 Yen
5,902,184 A 5/1999 Bennett et al.
5,911,418 A 6/1999 Adams
5,947,819 A 9/1999 Ohshima
5,947,820 A 9/1999 Morro et al.
5,951,397 A 9/1999 Dickinson
5,964,463 A 10/1999 Moore, Jr.
5,967,894 A 10/1999 Kinoshita et al.
5,980,384 A 11/1999 Barrie
5,984,781 A 11/1999 Sunaga
5,997,400 A 12/1999 Seelig et al.
5,997,401 A 12/1999 Crawford
6,004,207 A 12/1999 Wilson, Jr. et al.
6,007,426 A 12/1999 Kelly et al.
6,015,346 A 1/2000 Bennett
6,019,369 A 2/2000 Nakagawa et al.
6,033,307 A 3/2000 Vancura
6,056,642 A 5/2000 Bennett
6,059,289 A 5/2000 Vancura
6,059,658 A 5/2000 Mangano et al.
6,062,980 A 5/2000 Luciano
6,089,976 A 7/2000 Schneider et al.
6,089,977 A 7/2000 Bennett
6,089,978 A 7/2000 Adams
6,093,102 A 7/2000 Bennett
6,102,798 A 8/2000 Bennett
6,110,043 A 8/2000 Olsen
6,117,009 A 9/2000 Yoseloff
6,120,031 A 9/2000 Adams
6,126,541 A 10/2000 Fuchs
6,126,542 A 10/2000 Fier
6,126,547 A 10/2000 Ishimoto
6,135,885 A 10/2000 Lermusiaux
6,142,873 A 11/2000 Weiss et al.
6,142,874 A 11/2000 Kodachi et al.
6,142,875 A 11/2000 Kodachi et al.
6,146,273 A 11/2000 Olsen
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,120 A 12/2000 Takahashi et al.
6,162,121 A 12/2000 Morro et al.
6,164,652 A 12/2000 Lauretta et al.
6,165,070 A 12/2000 Nolte et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,189,886 B1 2/2001 Moran
6,190,254 B1 2/2001 Bennett
6,190,255 B1 2/2001 Thomas et al.
6,203,429 B1 3/2001 Demar et al.
6,210,279 B1 4/2001 Dickinson
6,213,876 B1 4/2001 Moore, Jr.
6,224,483 B1 5/2001 Mayeroff
6,231,442 B1 5/2001 Mayeroff
6,231,445 B1 5/2001 Acres
6,244,956 B1 6/2001 Nakayama et al.
6,261,177 B1 7/2001 Bennett
6,270,409 B1 8/2001 Shuster
6,270,416 B1 8/2001 Komoto
6,299,165 B1 10/2001 Nagano
6,302,790 B1 10/2001 Brossard
6,305,686 B1 10/2001 Perrie et al.
6,309,300 B1 10/2001 Glavich
6,312,334 B1 11/2001 Yoseloff
6,315,660 B1 11/2001 DeMar et al.
6,315,664 B1 11/2001 Baerlocher et al.
6,319,121 B1 11/2001 Yamada et al.
6,322,309 B1 11/2001 Thomas et al.
6,328,649 B1 12/2001 Randall et al.
6,346,043 B1 2/2002 Colin et al.
6,375,187 B1 4/2002 Baerlocher
6,398,218 B1 6/2002 Vancura
6,406,369 B1 6/2002 Baerlocher et al.
6,413,160 B1 7/2002 Vancura
6,413,161 B1 7/2002 Baerlocher et al.
6,425,827 B1 7/2002 Nimura
6,435,511 B1 8/2002 Vancura et al.
6,439,995 B1 8/2002 Hughs-Baird et al.
6,461,241 B1 10/2002 Webb et al.
6,464,582 B1 10/2002 Baerlocher et al.
6,494,783 B2 12/2002 Namba et al.
6,494,785 B1 12/2002 Gerrard et al.
6,506,118 B1 1/2003 Baerlocher et al.
6,511,375 B1 1/2003 Kaminkow
6,514,141 B1 2/2003 Kaminkow et al.
6,561,899 B2 5/2003 Vancura
6,569,015 B1 5/2003 Baerlocher et al.
6,575,830 B2 6/2003 Baerlocher et al.
6,582,306 B1 6/2003 Kaminkow
6,585,591 B1 7/2003 Baerlocher et al.
6,595,854 B2 7/2003 Hughs-Baird et al.
6,599,185 B1 7/2003 Kaminkow et al.
6,599,192 B1 7/2003 Baerlocher et al.
6,599,193 B2 7/2003 Baerlocher et al.
6,602,136 B1 8/2003 Baerlocher et al.
6,620,045 B2 9/2003 Berman et al.
6,632,141 B2 10/2003 Webb et al.
6,634,943 B1 10/2003 Baerlocher
6,638,164 B2 10/2003 Randall et al.
6,648,754 B2 11/2003 Baerlocher et al.
6,659,864 B2 12/2003 McGahn et al.
6,663,489 B2 12/2003 Baerlocher
6,682,073 B2 1/2004 Bryant et al.
6,688,975 B2 2/2004 Baerlocher et al.
6,692,355 B2 2/2004 Baerlocher et al.
6,719,632 B2 4/2004 Palmer et al.
6,722,981 B2 4/2004 Kaminkow et al.
6,722,982 B2 4/2004 Kaminkow et al.
6,726,563 B1 4/2004 Baerlocher et al.
6,731,313 B1 5/2004 Kaminkow
6,758,747 B2 7/2004 Baerlocher
6,758,750 B2 7/2004 Baerlocher et al.
6,767,283 B1 7/2004 Weiss
6,776,711 B1 8/2004 Baerlocher
6,780,110 B2 8/2004 Baerlocher et al.
6,786,820 B2 9/2004 Gerrard et al.
6,793,579 B2 9/2004 Baerlocher et al.
6,796,899 B2 9/2004 Baerlocher
6,796,900 B2 9/2004 Baerlocher et al.
6,796,905 B2 9/2004 Baerlocher et al.
6,808,452 B2 10/2004 Baerlocher et al.
6,808,454 B2 10/2004 Gerrard et al.
6,811,483 B1 11/2004 Webb et al.
6,852,030 B2 2/2005 Baerlocher et al.
6,890,257 B2 5/2005 Baerlocher
6,899,623 B2 5/2005 Baerlocher
6,942,566 B2 9/2005 Baerlocher et al.
6,942,567 B2 9/2005 Baerlocher et al.
6,951,516 B1 10/2005 Eguchi et al.
6,960,132 B2 11/2005 Baerlocher et al.
6,966,833 B2 11/2005 Kaminkow et al.
6,971,953 B2 12/2005 Gerrard et al.
7,001,273 B2 2/2006 Baerlocher
7,033,272 B1 4/2006 Mason

(56) References Cited

U.S. PATENT DOCUMENTS

| | | | |
|---|---|---|---|
| 7,040,984 | B2 | 5/2006 | Mead |
| 7,160,186 | B2 | 1/2007 | Cuddy et al. |
| 7,192,349 | B2 | 3/2007 | Baerlocher et al. |
| 7,264,545 | B2 | 9/2007 | Maya et al. |
| 7,270,604 | B2 | 9/2007 | Gerrard et al. |
| 7,364,507 | B2 | 4/2008 | Baerlocher et al. |
| 7,470,190 | B2 | 12/2008 | Baerlocher et al. |
| 7,601,057 | B2 | 10/2009 | Kaminkow |
| 7,722,451 | B2 | 5/2010 | Hughs-Baird et al. |
| 7,722,463 | B2 | 5/2010 | Maya et al. |
| 7,731,582 | B2 | 6/2010 | Randall et al. |
| 7,794,316 | B2 | 9/2010 | Palmer et al. |
| 7,901,287 | B2 | 3/2011 | Simms et al. |
| 7,942,737 | B2 | 5/2011 | Cregan et al. |
| 7,963,842 | B2 | 6/2011 | Ruymann |
| 2002/0045475 | A1 | 4/2002 | Glavich et al. |
| 2002/0072402 | A1 | 6/2002 | Baerlocher |
| 2002/0077176 | A1 | 6/2002 | Yanaki |
| 2002/0132660 | A1 | 9/2002 | Taylor |
| 2002/0142821 | A1 | 10/2002 | Baerlocher |
| 2002/0142822 | A1 | 10/2002 | Baerlocher et al. |
| 2002/0142823 | A1 | 10/2002 | DeMar et al. |
| 2002/0151341 | A1 | 10/2002 | Baerlocher et al. |
| 2002/0151350 | A1 | 10/2002 | Baerlocher et al. |
| 2002/0151357 | A1 | 10/2002 | Acres |
| 2002/0155873 | A1 | 10/2002 | Berman et al. |
| 2002/0155883 | A1 | 10/2002 | Baerlocher |
| 2002/0165019 | A1 | 11/2002 | Slomiany |
| 2002/0187827 | A1 | 12/2002 | Blankstein |
| 2003/0013514 | A1 | 1/2003 | Cregan et al. |
| 2003/0040355 | A1 | 2/2003 | Baerlocher |
| 2003/0040360 | A1 | 2/2003 | Kaminkow |
| 2003/0045344 | A1 | 3/2003 | Webb et al. |
| 2003/0045348 | A1 | 3/2003 | Palmer et al. |
| 2003/0045350 | A1 | 3/2003 | Baerlocher et al. |
| 2003/0060260 | A1 | 3/2003 | Gerrard et al. |
| 2003/0064795 | A1 | 4/2003 | Baerlocher et al. |
| 2003/0078093 | A1 | 4/2003 | Simms et al. |
| 2003/0087693 | A1 | 5/2003 | Baerlocher et al. |
| 2003/0090063 | A1 | 5/2003 | Jarvis et al. |
| 2003/0157982 | A1 | 8/2003 | Gerrard et al. |
| 2003/0162584 | A1 | 8/2003 | Hughs-Baird et al. |
| 2003/0211880 | A1 | 11/2003 | Locke |
| 2004/0009805 | A1 | 1/2004 | Baerlocher et al. |
| 2004/0023707 | A1 | 2/2004 | Maya et al. |
| 2004/0038729 | A1 | 2/2004 | Webb et al. |
| 2004/0072607 | A1 | 4/2004 | Thomas et al. |
| 2004/0102238 | A1 | 5/2004 | Taylor |
| 2004/0106444 | A1 | 6/2004 | Cuddy et al. |
| 2004/0162128 | A1 | 8/2004 | Baerlocher et al. |
| 2004/0180710 | A1 | 9/2004 | Palmer et al. |
| 2004/0185928 | A1 | 9/2004 | Baerlocher et al. |
| 2004/0214632 | A1 | 10/2004 | Cuddy et al. |
| 2005/0020346 | A1 | 1/2005 | Baerlocher |
| 2005/0032567 | A1 | 2/2005 | Baerlocher et al. |
| 2005/0037829 | A1 | 2/2005 | Baerlocher et al. |
| 2005/0049036 | A1 | 3/2005 | Mead |
| 2005/0054413 | A1 | 3/2005 | Randall et al. |
| 2005/0055115 | A1 | 3/2005 | Gerrard et al. |
| 2005/0101375 | A1 | 5/2005 | Webb et al. |
| 2005/0130729 | A1 | 6/2005 | Baerlocher et al. |
| 2005/0153767 | A1 | 7/2005 | Gauselmann |
| 2005/0187010 | A1 | 8/2005 | Baerlocher |
| 2005/0197180 | A1 | 9/2005 | Kaminkow et al. |
| 2005/0266914 | A1 | 12/2005 | Baerlocher et al. |
| 2006/0003837 | A1 | 1/2006 | Baerlocher et al. |
| 2006/0160592 | A1 | 7/2006 | Endo et al. |
| 2006/0172791 | A1 | 8/2006 | Wolf |
| 2007/0072673 | A1 | 3/2007 | Bennett et al. |
| 2008/0214267 | A1* | 9/2008 | Ghaly ..... 463/17 |
| 2009/0280891 | A1* | 11/2009 | Filipour et al. ..... 463/22 |
| 2010/0004056 | A1* | 1/2010 | Walker et al. ..... 463/25 |

FOREIGN PATENT DOCUMENTS

| | | |
|---|---|---|
| EP | 0 944 030 | 9/1999 |
| EP | 0 945 837 | 9/1999 |
| EP | 0 981 119 | 2/2000 |
| EP | 0 984 407 | 3/2000 |
| EP | 0 984 408 | 3/2000 |
| EP | 0 984 409 | 3/2000 |
| EP | 2 353 128 | 2/2001 |
| EP | 1 175 928 | 1/2002 |
| EP | 1 298 609 | 4/2003 |
| WO | PCT/AU97/00121 | 9/1997 |
| WO | WO 9732285 | 9/1997 |
| WO | WO 00/12186 | 3/2000 |
| WO | WO 01/19476 | 3/2001 |

OTHER PUBLICATIONS

The Video Game Theory Reader, written by Holland et al., Publication available prior to Aug. 2, 2012.

* cited by examiner

FIG. 3

| Round Number | Offer Number | Award Amount of Offer | Number of Strikes of Offer | Offer Accepted, Offer Rejected, Final Offer | Total Award Amount | Total Number of Strikes |
|---|---|---|---|---|---|---|
| 1 | 1 | 300 | 2 | Rejected | 0 | 0 |
| 1 | 2 | 100 | 0 | Accepted | 100 | 0 |
| 2 | 1 | 600 | 3 | Accepted | 700 | 3 |
| 3 | 1 | 400 | 2 | Rejected | 700 | 3 |
| 3 | 2 | 250 | 3 | Rejected | 700 | 3 |
| 3 | 3 | 400 | 1 | Final Offer | 1100 | 4 |
| 4 | 1 | 350 | 0 | Rejected | 1100 | 4 |
| 4 | 2 | 750 | 0 | Rejected | 1100 | 4 |
| 4 | 3 | 1250 | 0 | Final Offer | 2350 | 4 |

FIG. 4

| Round | Low Award | High Award | Low Strikes | High Strikes |
|---|---|---|---|---|
| 1 | 50 | 600 | 0 | 3 |
| 2 | 150 | 900 | 1 | 4 |
| 3 | 250 | 1200 | 1 | 4 |
| 4 | 350 | 2000 | n/a | n/a |

GAMING SYSTEM AND METHOD FOR PROVIDING AN OFFER AND ACCEPTANCE GAME

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which provide secondary or bonus games are also known. The secondary or bonus games usually provide an additional award, such as a bonus award, to the player. Secondary or bonus games usually do not require an additional wager by the player to be activated. Instead, secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine generally indicates this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

One such type of secondary or bonus game is an offer and acceptance game which enables players to accept or decline multiple award offers. One such gaming device provides the player with a quantity of offers and a final award. When an offer is given, the player may accept or reject the offer. If the player accepts an offer, the player receives the accepted offer amount and the bonus game terminates. If the player declines an offer, the game generates another offer for the player. The player is automatically provided with the last selected offer if the player rejects each of the quantity of previous offers. In this known offer/acceptance game, when the player rejects an offer, the player risks a current or guaranteed award for a higher value award. The game may instead provide a lower award. The game thus creates a risk for the player. Enabling a player to pick from different risk based alternatives and then enabling the player to accumulate awards or offers from the selected alternatives provides excitement and enjoyment to the player. A continuing need exists to provide offer/acceptance games that enable a player to weigh options and explore the consequences of selecting those options where the player may accumulate awards or offers.

SUMMARY

The present disclosure relates generally to gaming systems and methods for providing an offer and acceptance game.

In various embodiments, the offer and acceptance game disclosed herein is a multi-round offer and acceptance game, wherein the player's decisions during one or more rounds of the offer and acceptance game determine, at least in part, whether the player will play or participate in each of the subsequent rounds of the offer and acceptance game. In these embodiments, for each played round of the offer and acceptance game, the gaming system enables the player to accept or reject one or more different offers which have different award values and also contribute different amounts toward terminating the play of the offer and acceptance game.

In operation of different embodiments of the gaming system disclosed herein, upon an occurrence of a suitable triggering event, the gaming system initiates an offer and acceptance game having a plurality or rounds or levels. For each played round or level of the initiated offer and acceptance game, the gaming system determines and displays one or more multi-component offers, each including a plurality of different offer components. In one such embodiment, the multi-component offer includes a determined award component such as an award amount, and a determined termination component, such as a quantity of terminators. In one embodiment, the different rounds or levels of the offer and acceptance game are associated with different ranges of available award amounts (to form the award component of the multi-component offer) and different available quantities of terminators (to form the termination component of the multi-component offer). In one such embodiment, as the offer and acceptance game proceeds from round to round, the average expected amount of the award component and the average expected quantity of terminators of the termination component increases such that the player's decisions regarding which multi-component offers to accept have a greater magnitude, on average, toward continuing or terminating the play of the offer and acceptance game.

If the determined multi-component offer is not a final offer for that round or level, the gaming system enables the player to accept or reject the determined multi-component offer. If the player rejects the determined offer and the determined offer is not a final offer for that round or level, the gaming system determines another multi-component offer (including another award component and another termination component) and proceeds as described above.

If the player accepts the determined multi-component offer (or if the determined multi-component offer is the final offer for that round or level), the gaming system provides the player each of the individual components of that determined multi-component offer. In one embodiment wherein a multi-component offer includes an award component of an award amount, and a termination component of a quantity of terminators, if the player accepts the determined multi-component offer (or if the determined multi-component offer is the final offer for that round or level), the gaming system provides the player the award amount of the multi-component offer and also accumulates the quantity of terminators of the multi-component offer.

After providing the player each of the components of the accepted or final multi-component offer, the gaming system determines whether the termination component of the accepted or final multi-component offer causes a satisfaction of a termination condition. In one embodiment wherein a multi-component offer includes an award component of an award amount, and a termination component of a quantity of terminators, the gaming system determines whether the accumulated quantity of terminators has reached a termination threshold. That is, the gaming system determines whether a total quantity of terminators accumulated over each of the played rounds or levels of the offer and acceptance game has reached a termination threshold.

If the termination condition is satisfied (e.g., if the quantity of accumulated terminators has reached the termination threshold), then regardless of whether the player has advanced to and played each of the rounds or levels of the offer and acceptance game, the gaming system terminates the play of the offer and acceptance game. That is, if the termination condition is satisfied prior to the play of at least the final round or level, the player forfeits or forgoes the play of at least the final round or level of the offer and acceptance game. It should be appreciated that unlike other gaming systems with offer and acceptance games, if the termination condition is satisfied, the gaming system still provides the player each accepted offer (or each final offer) for each played round of the offer and acceptance game.

If the termination condition is not satisfied, the gaming system determines whether any unplayed rounds or levels remain for the play of the offer and acceptance game. If no unplayed rounds or levels remain for the play of the offer and acceptance game, the gaming system terminates the play of the offer and acceptance game. On the other hand, if at least one unplayed round or level remains for the play of the offer and acceptance game, the gaming system proceeds to the next round or level and, as described above, determines a multi-component offer including a plurality of different offer components. In this embodiment, as long as the termination condition remains unsatisfied (e.g., as long as the player has not accumulated enough terminators to end the play of the offer and acceptance game), then even after accepting an offer for one round, the gaming system advances to one or more subsequent rounds and proceeds as described above. This process continues until either the termination condition is satisfied or the player has completed the final round or level, at which point the gaming system terminates the offer and acceptance game.

Such a multi-component offer configuration provides that certain players will account for different variables (and in certain instances, different competing variables) when determining whether to accept or reject each offer. For example, a multi-component offer with a relatively large award amount and also a relatively large quantity of terminators presents the player with a choice of accepting such an offer and winning the relatively large award amount (while also accumulating the relatively large quantity of terminators) or rejecting such an offer and forgoing the relatively large award offer (while also avoiding an accumulation of the relatively large quantity of terminators). Accordingly, the gaming system described herein provides an interesting and exciting game for players wherein the player's individual decisions regarding which multi-component offers to accept, determines how quickly, if at all, the termination condition is satisfied, which determines, at least in part, a total quantity of offers which the player may accept or reject.

Additional features and advantages are described in, and will be apparent from, the following Detailed Description and the figures.

BRIEF DESCRIPTION OF THE FIGURES

FIG. 3 is a table illustrating the different results from the complete play of the multiple round offer and acceptance game of FIGS. 2A to 2E.

FIG. 4 is a table illustrating an example of the different distributions of available awards and available quantities of terminators utilized in association with different rounds of the multiple round offer and acceptance game.

DETAILED DESCRIPTION

Offer and Acceptance Game

In various embodiments, the offer and acceptance game disclosed herein is a multi-round offer and acceptance game, wherein the player's decisions during one or more rounds of the offer and acceptance game determine, at least in part, whether the player will play or participate in each of the subsequent rounds of the offer and acceptance game. In these embodiments, for each played round of the offer and acceptance game, the gaming system enables the player to accept or reject one or more different offers which have different award values and also contribute different amounts toward terminating the play of the offer and acceptance game.

While the embodiments described below are directed to a secondary or bonus game, it should be appreciated that the present disclosure may additionally or alternatively be employed in association with a primary or base wagering game. Moreover, while the players credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
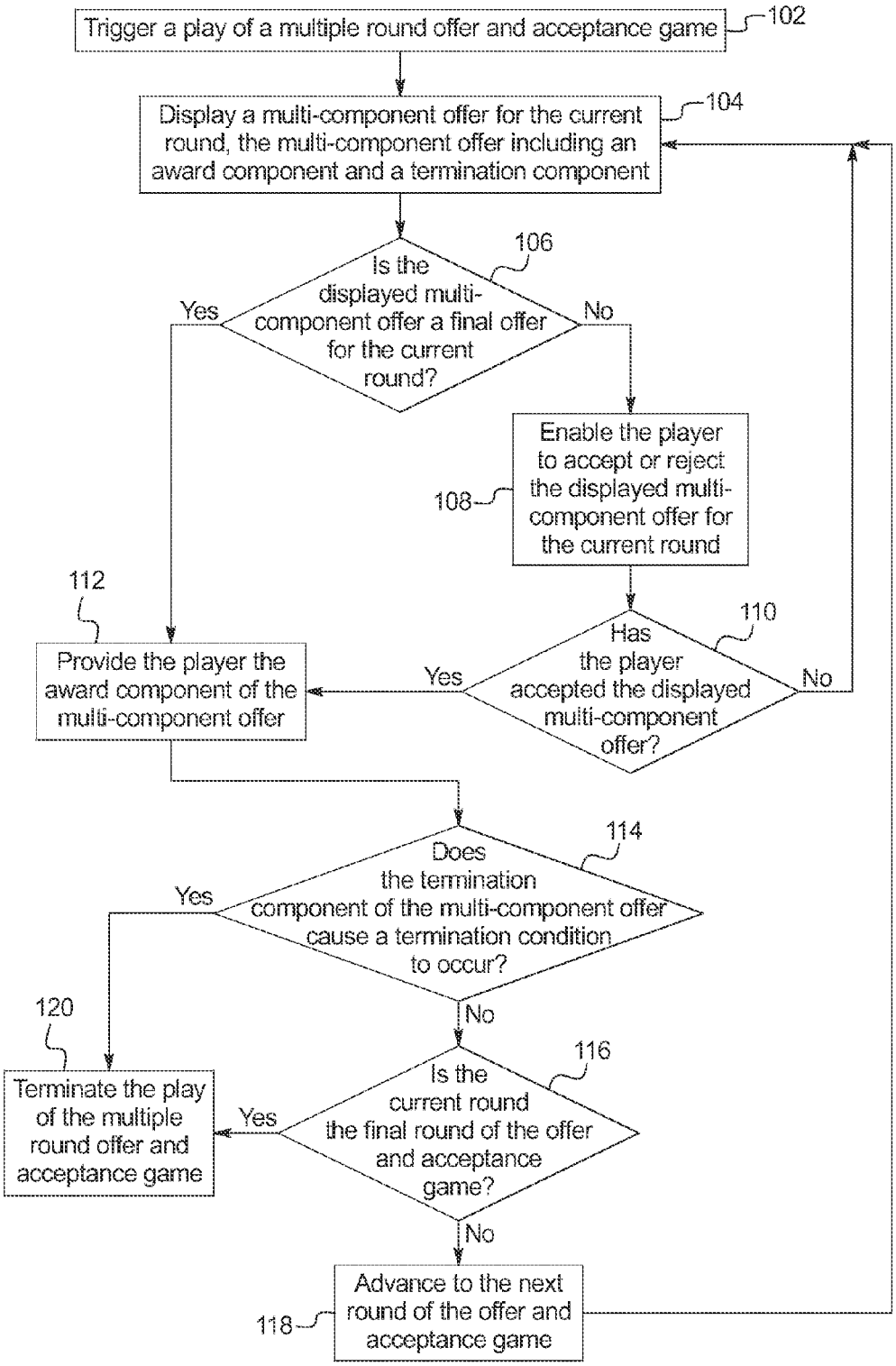
FIG. 1 is a flow chart an example process for operating a gaming system providing one embodiment of the multiple round offer and acceptance game disclosed herein.

Referring now to FIG. 1, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, upon an occurrence of an offer and acceptance game triggering event, as indicated in block 102 of FIG. 1, the gaming system triggers a play of a multiple round offer and acceptance game (and specifically triggers a play of a first round of a multi-round offer and acceptance game). In one embodiment, the offer and acceptance game is a secondary or bonus game wherein an offer and acceptance game triggering event occurs based on a displayed event associated with a wagered on play of a primary game. In another such embodiment wherein the offer and acceptance game is a secondary or bonus game, an offer and acceptance game triggering event occurs based on an event independent of any displayed event associated with a wagered on play of a primary game. For example, after a designated period of time, the gaming system causes an offer and acceptance game triggering event to occur. In another such embodiment, the offer and acceptance game is a primary game wherein an offer and acceptance game triggering event occurs upon a player placing a wager to play the offer and acceptance game.

In one embodiment, for the triggered offer and acceptance game, the gaming system displays a multi-component offer for the current round or level as indicated in block 104. The multi-component offer includes a plurality of different displayed components, such as one component which affects the award of the offer and acceptance game and another component which affects the duration of the offer and acceptance game.

In one such embodiment, one component of the multi-component offer is a termination component, such as a quantity of terminators or modifications of a termination meter.

In one such embodiment, one component of the multi-component offer is an award component of an award amount, such as one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage of one or more wagering games for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on the internet.

As indicated in diamond 106, the gaming system determines if the displayed multi-component offer is a final offer for the current round or level. For example, if a round of the multiple round offer and acceptance game includes four multi-component offers and the player has previously rejected three multi-component offers for that round, the fourth displayed multi-component offer represents the final or last offer for that round or level. In one embodiment, each round of the multiple round offer and acceptance game includes a same quantity of available offers, such as three offers per round. In another embodiment, a plurality of the rounds of the multiple round offer and acceptance game each include different quantities of available offers for the player to accept or reject.

If the gaming system determines that the displayed multi-component offer is not the final offer for the current round or level, as indicated in block 108, the gaming system enables the player to accept or reject the displayed multi-component offer for the current round or level. If the gaming system determines that the player rejected (i.e., did not accept) the displayed multi-component offer for the current round or level, the gaming system returns to block 104, displays another multi-component offer for the current round or level and proceeds as described above until the player accepts the multi-component offer or until the determined multi-component offer is a final offer for that round or level.

If the gaming system determines that the player accepted the displayed multi-component offer or if the gaming system determines that the displayed multi-component offer is the final offer for the current round or level, the gaming system provides the award component of the accepted multi-component offer to the player as indicated in diamond 110 and block 112. It should be appreciated that if the player accepts a displayed multi-component offer for a round or level of the offer and acceptance game, the gaming system does not display to the player any additional multi-component offers for that round or level.

Following providing the player the award component of the multi-component offer, the gaming system determines whether the termination component of the multi-component offer causes a termination condition to occur or be satisfied as in diamond 114. In one such embodiment wherein the termination component is a quantity of terminators, upon accepting the displayed multi-component offer (or upon the displayed multi-component offer being the final offer for the current round or level), the gaming system accumulates each of the quantity of terminators of the multi-component offer. In this embodiment, the gaming system determines whether the termination component of the multi-component offer causes the termination condition to be satisfied by determining whether the accumulated quantity of terminators for the multi-component offer has reached a termination threshold. That is, the gaming system of this embodiment determines whether a total quantity of terminators accumulated over each of the played rounds or levels of the offer and acceptance game has reached a termination threshold.

If the termination component of the multi-component offer does not cause the termination condition to occur or be satisfied, the gaming system determines whether the current round of the multiple round offer and acceptance game is a final round as indicated in diamond 116. That is, the gaming system determines if any unplayed rounds or levels remain for the play of the offer and acceptance game.

If the current round of the multiple round offer and acceptance game is not the final round, the gaming system advances to the next round or level and proceeds with displaying another multi-component offer for the current round or level (i.e., the next round or level) as indicated in blocks 118 and 104. In this embodiment, as long as the termination component of any accepted offer (or any final offer for a specific round) does not cause the termination condition to occur or be satisfied, then even after accepting a multi-component offer for one round, the gaming system advances to one or more subsequent rounds and proceeds with displaying one or more additional multi-component offers for one or more subsequent rounds.

On the other hand, if the current round of the multiple round offer and acceptance game is the final round, the gaming system terminates the play of the multiple round offer and acceptance game as indicated in block 120.

Moreover, if the termination component of the multi-component offer causes the termination condition to occur or be satisfied, then regardless of whether the player has advanced to and played each of the rounds or levels of the offer and acceptance game, the gaming system terminates the play of the multiple round offer and acceptance game as indicated in block 120. In one embodiment wherein the termination component is a quantity of terminators, if the player's accumulated quantity of terminators reaches the termination threshold prior to the play of at least the final round or level, the player forfeits or forgoes the play of at least the final round or level of the offer and acceptance game. Such a configuration thus provides an interesting and exciting game for players wherein the player's individual decisions regarding which multi-component offers to accept, determines how quickly, if at all, the player reaches the termination threshold, which determines, at least in part, a total quantity of offers which the player may accept or reject.

In one example embodiment of the gaming system disclosed herein, as seen in FIGS. 2A to 2E, a play of the multiple round offer and acceptance game includes up to four rounds 140 with up to three multi-component offers available per round and a total quantity of five terminators (illustrated as strikes) 142 which may be accumulated (prior to the fifth round) before the offer and acceptance game is terminated.

Figure 2A:
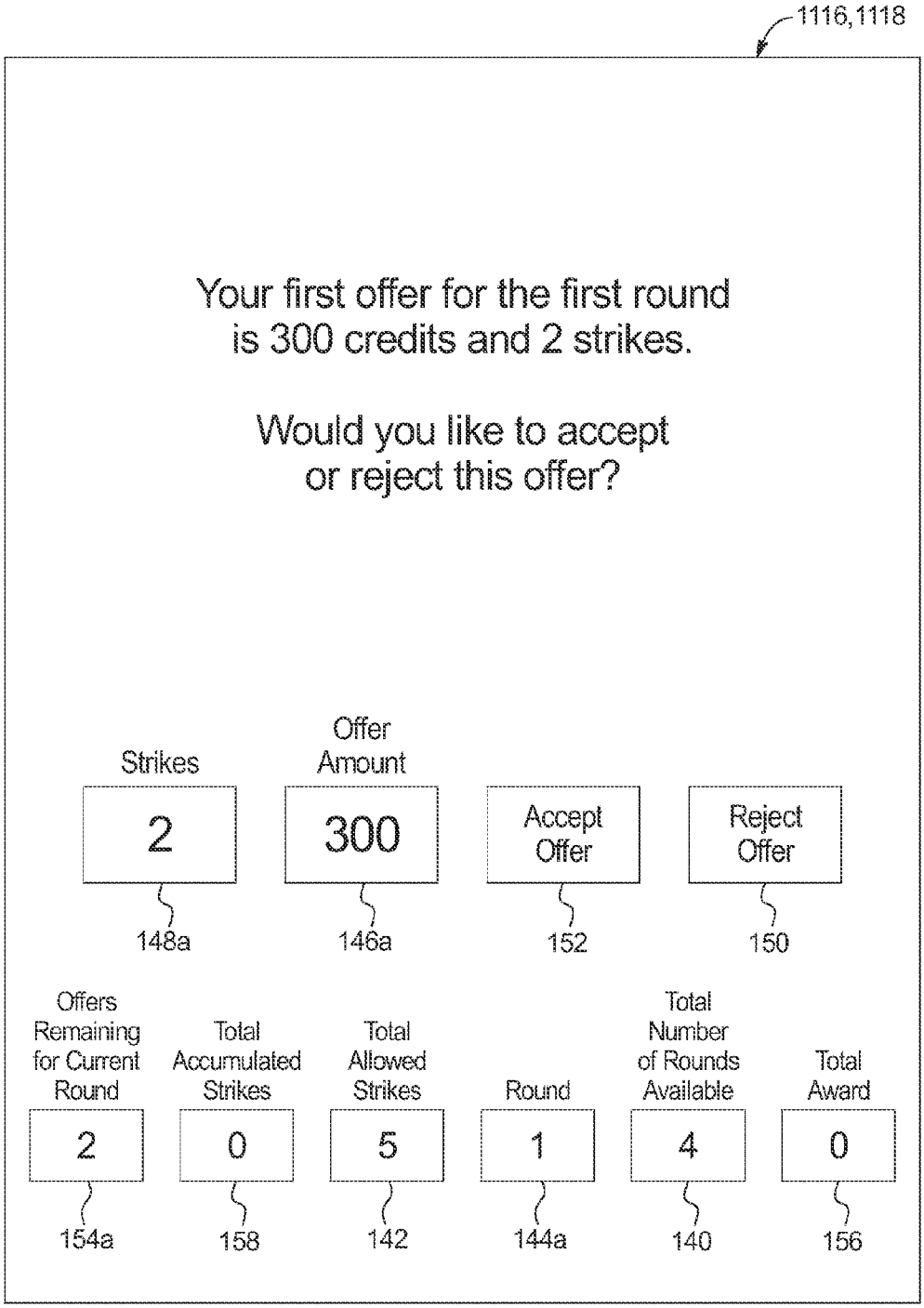
FIGS. 2A, 2B, 2C, 2D and 2E are front views of one embodiment of the gaming system disclosed herein illustrating a partial play of a multiple round offer and acceptance game.
Figure 2B:
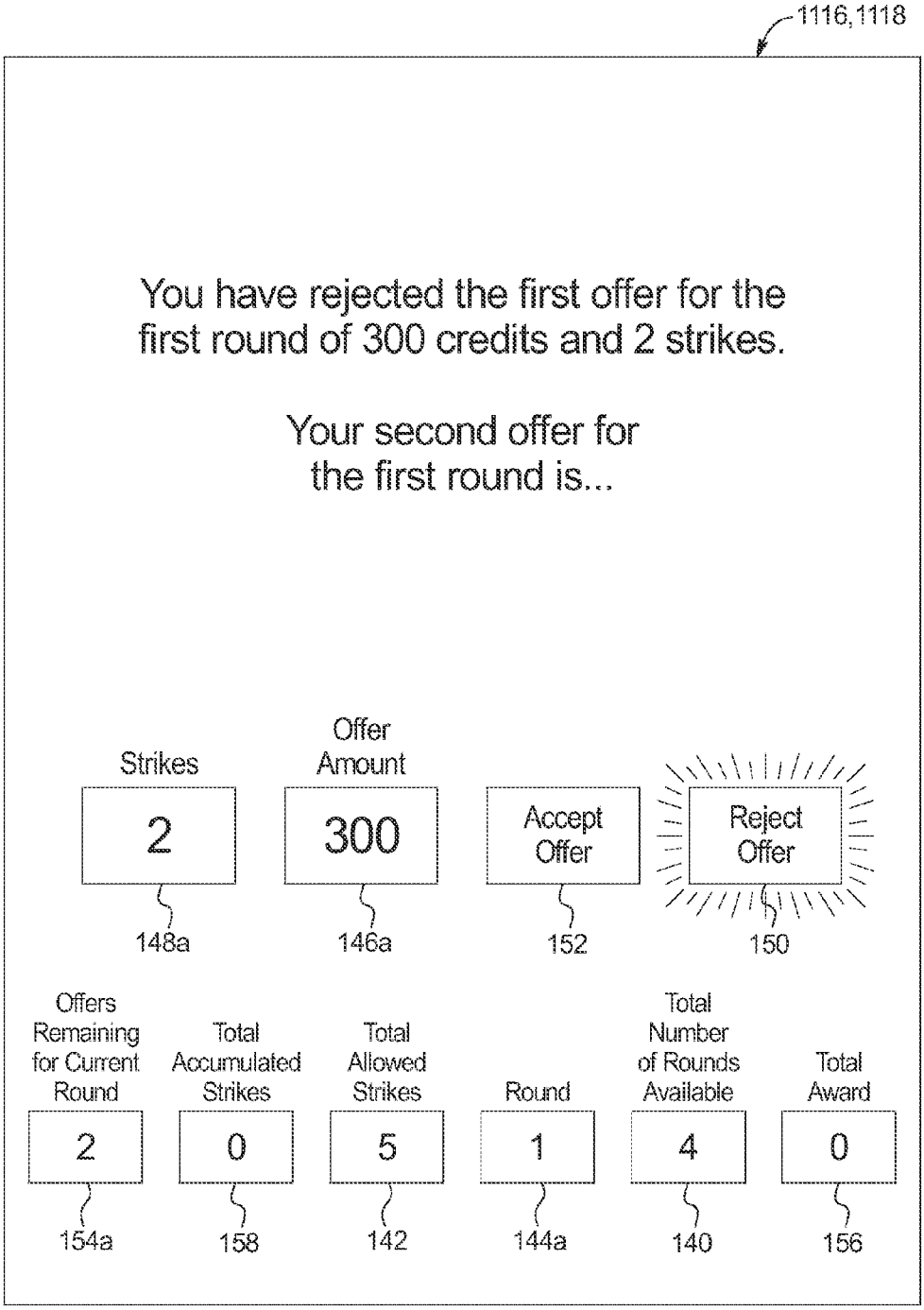

In operation of this example embodiment, as seen in FIGS. 2A and 2B, for a first round 144*a* of the multi-round offer and acceptance game, the gaming system offers the player a first multi-component offer of three-hundred credits 146*a* and two terminators (illustrated as strikes) 148*a*. In this example, while the amount of credits associated with this first offer is relatively high, the player determines that the quantity of terminators associated with this first offer is too high and thus the player rejects the offer using the reject offer input 150. The gaming system then determines that since the player has at least one offer left for the first round (i.e., the first offer was not a final offer for the first round), the gaming system will determine another multi-component offer for the current round. In this example, the gaming system provides appropriate messages such as "YOUR FIRST OFFER FOR THE FIRST ROUND IS 300 CREDITS AND 2 STRIKES", "WOULD YOU LIKE TO ACCEPT OR REJECT THIS OFFER?", "YOU HAVE REJECTED THE FIRST OFFER OF 300 CREDITS AND 2 STRIKES" and "YOUR SECOND OFFER FOR THE FIRST ROUND IS . . . " to the player visually, or through suitable audio or audiovisual displays.

Figure 2C:
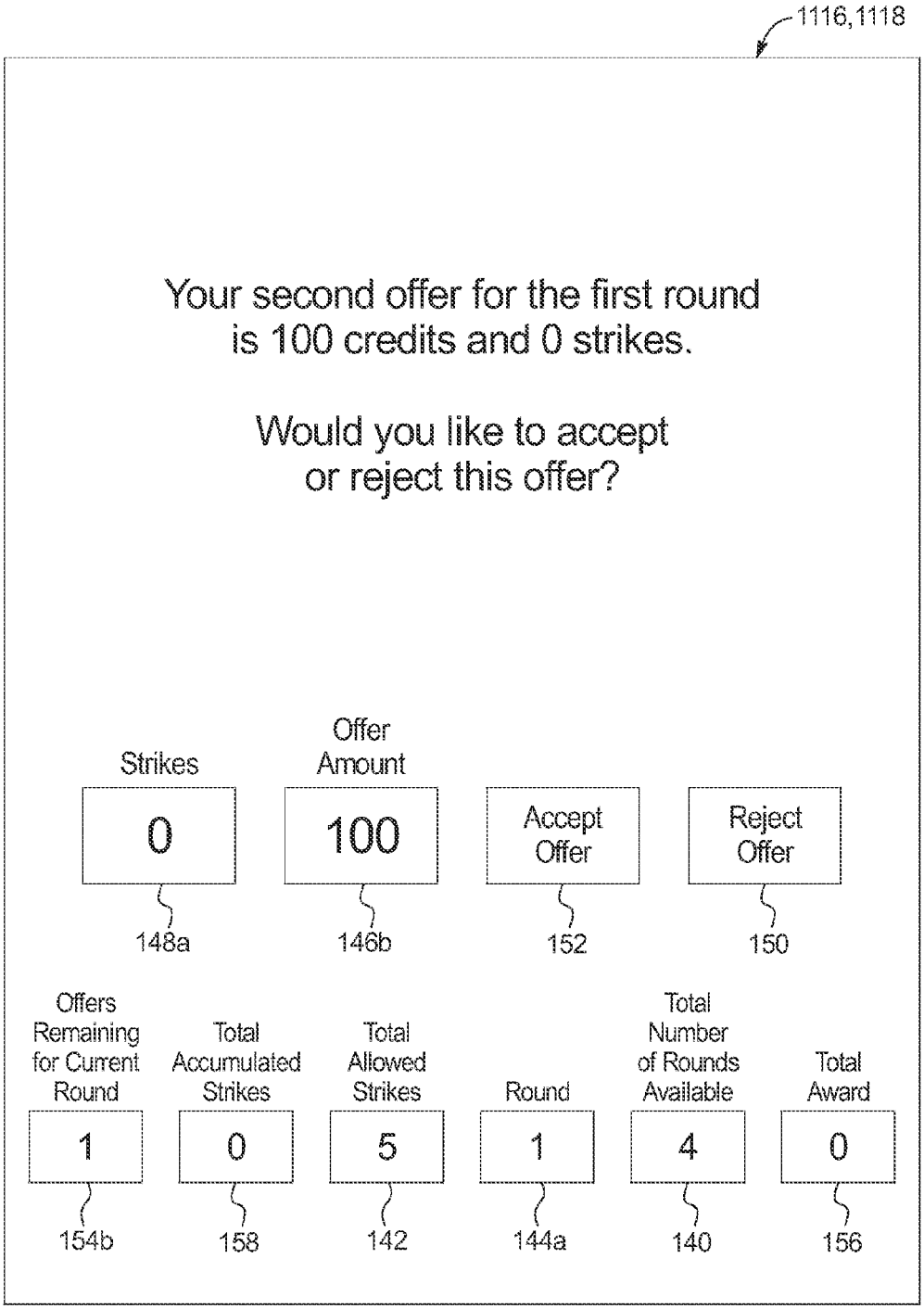
Figure 2D:
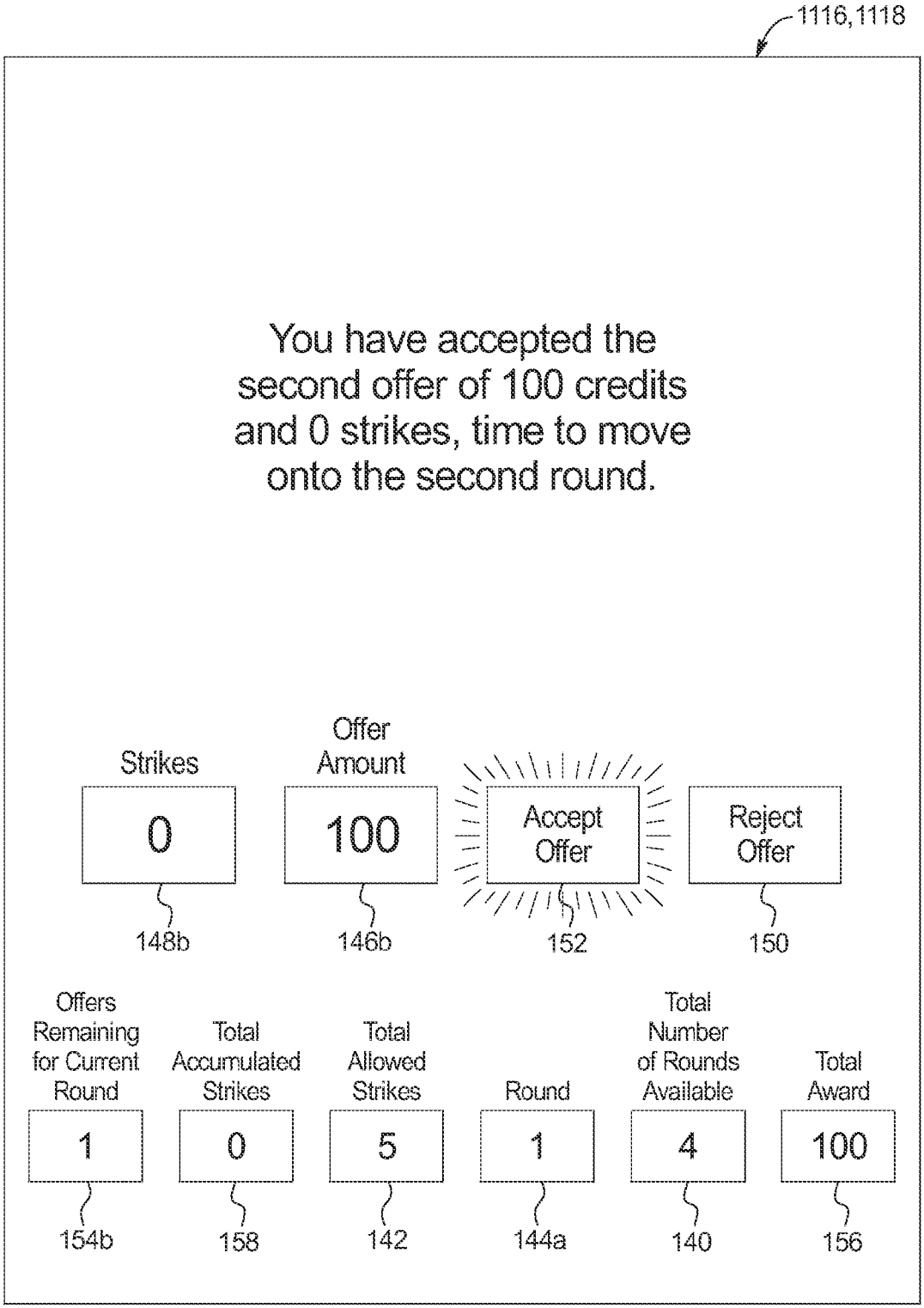

After rejecting the first offer of the first round and after determining that the player has at least one offer left for the first round 152*a*, as seen in FIGS. 2C and 2D, the gaming system offers the player a second multi-component offer of one-hundred credits 146*b* and zero terminators (illustrated as strikes) 148*b* for the first round. In this example, while the amount of credits associated with this second offer is relatively low, the player determines that the quantity of zero terminators associated with this second offer is too good to pass up and thus the player accepts the offer using the accept offer input 152. Accordingly, the total award indicator 156 is updated to indicate the accepted award component of the multi-component offer of one-hundred credits and the total accumulated strikes indicator 158 is updated to indicate the accepted termination component of the multi-component offer of zero strikes.

Following the acceptance of the second offer of the first round, the gaming system determines that the player's total quantity of zero terminators is less than the total allowed quantity of five terminators (i.e., the gaming system determines that the termination component of the accepted offer does not satisfy the termination condition). The gaming system then determines that the first round was not the final round of the offer and acceptance game and thus advances the player to the second round of the offer and acceptance game. In this example, as seen in FIGS. 2C and 2D, the gaming system provides appropriate messages such as "YOUR SECOND OFFER FOR THE FIRST ROUND IS 100 CREDITS AND 0 STRIKES", "WOULD YOU LIKE TO ACCEPT OR REJECT THIS OFFER?", "YOU HAVE ACCEPTED THE SECOND OFFER OF 100 CREDITS AND 0 STRIKES" and "TIME TO MOVE ONTO THE SECOND ROUND" to the player visually, or through suitable audio or audiovisual displays.

Figure 2E:
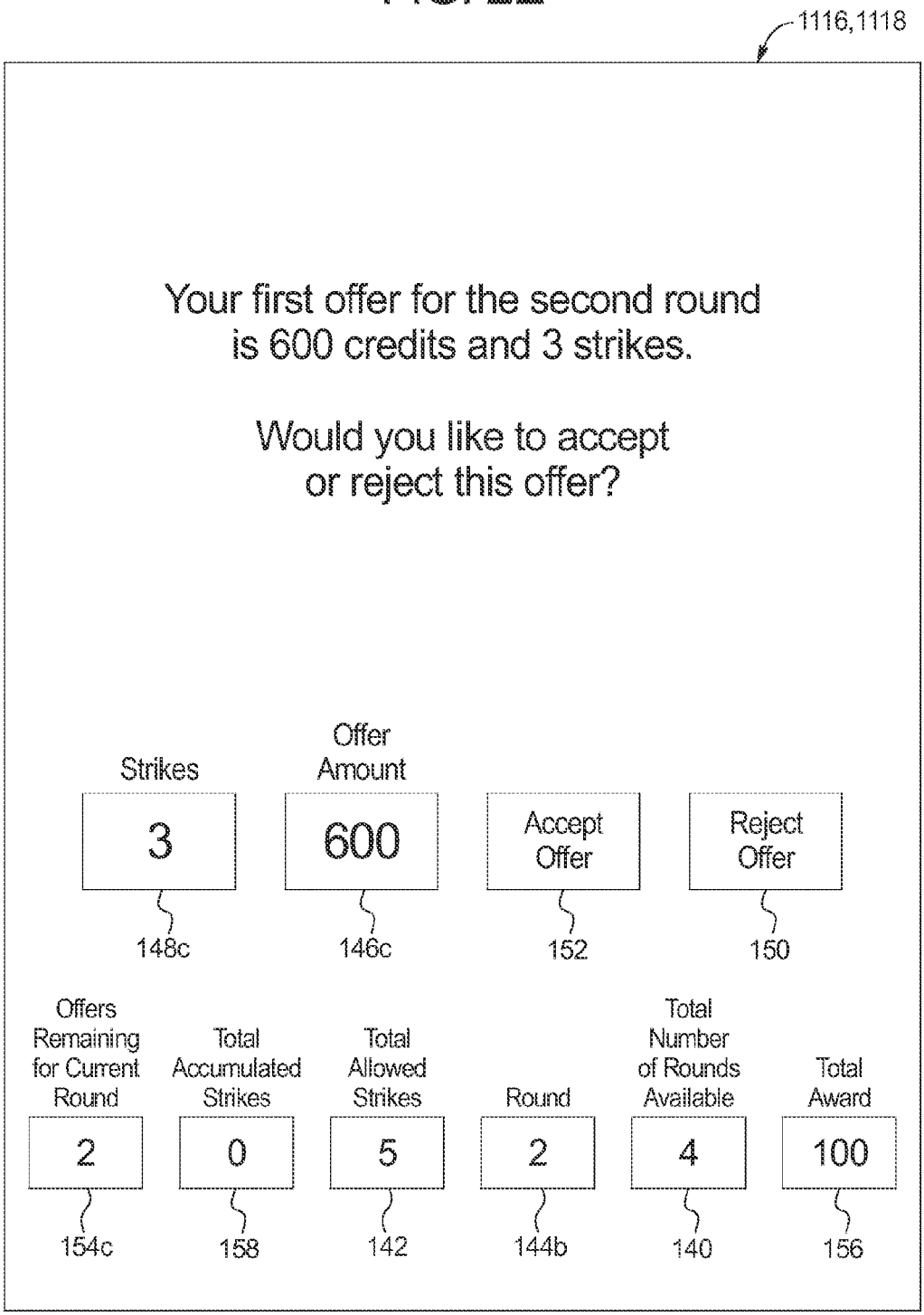

After accepting the second offer of the first round and determining to advance the player to another round, as seen in FIG. 2E, the gaming system offers the player a first multi-component offer of six-hundred credits 146*c* and three terminators (illustrated as strikes) 148*c* for the second round. In this example, the gaming system provides appropriate messages such as "YOUR FIRST OFFER FOR THE SECOND ROUND IS 600 CREDITS AND 3 STRIKES" and "WOULD YOU LIKE TO ACCEPT OR REJECT THIS OFFER?" to the player visually, or through suitable audio or audiovisual displays.

Continuing with this example, FIG. 3 is a table illustrating the results of the remaining plays of the remaining rounds of the multi-round offer and acceptance game. As seen in FIG. 3, the player accepted the multi-component offer of six-hundred credits and three terminators for the second round. Since the three accumulated terminators at the end of the second round is less than the termination threshold of five accumulated terminators and since the second round was not the final round of the multiple round offer and acceptance game, the gaming system proceeded to the third round. During the third round, the player rejected the first two multi-component offers and was provided the third and final multi-component offer of four-hundred credits and one terminator. Since the four accumulated terminators at the end of the third round is less than the termination threshold of five accumulated terminators and since the third round was not the final round of the multiple round offer and acceptance game, the gaming system proceeded to the fourth and final round. During the fourth and final round, the player rejected the first two multi-component offers and was provided the third and final multi-component offer of one-thousand-two-hundred-fifty credits. Since the fourth round was the final round, the gaming system terminated the play of the offer and acceptance game. Accordingly, the player's total award for this play of the offer and acceptance game is two-thousand-three-hundred-fifty credits. In this illustrated example, the player's decisions regarding which offers to accept and which offers to accept enabled the player to reach the final round and complete the offer and acceptance game.

In one embodiment, each of the different rounds or levels are associated with different offer amounts and different quantities of terminators. In one such embodiment, the higher the round or level of the offer and acceptance game, the higher the offer amount, on average, available for that round or level. In another such embodiment, with the exception of the final round which includes offers without any termination components, the higher the round or level of the offer and acceptance game, the higher the quantity of terminators, on average, of the offers for that round or level. Such a configuration presents certain players with interesting choices, such as whether they should focus on collecting fewer terminators to reach higher rounds or levels of should they focus on taking the highest award components during the lower rounds or levels even if such higher award components are coupled with higher quantities of terminators.

In one embodiment, as seen in FIG. 4, the gaming system determines an award amount of the award component of the multi-component offer from a range of award amounts. In one such embodiment, for each multi-component offer, the gaming system randomly selects an award amount from a weighted table of award amounts. In one such embodiment, the gaming system utilizes the same range of award amounts (or the same weighted table of award amounts) for each of the rounds of the offer and acceptance game. In another such embodiment, as also seen in FIG. 4, the gaming system utilizes different ranges of award amounts (or different weighted tables of award amounts) for each of a plurality of the rounds of the offer and acceptance game.

In one embodiment, as seen in FIG. 4, the gaming system determines a quantity of terminators (illustrated as strikes) of the termination component of the multi-component offer from a range of quantities of terminators. In one such embodiment, for each multi-component offer, the gaming system randomly selects a quantity of terminators from a weighted table of quantities of terminators. In one such embodiment, the gaming system utilizes the same range of quantities of terminators (or the same weighted table of quantities of terminators) for each of the rounds of the offer and acceptance game. In another such embodiment, as also seen in FIG. 4, the gaming system utilizes different ranges of quantities of terminators (or different weighted tables of quantities of terminators) for each of a plurality of the rounds of the offer and acceptance game.

In one embodiment, for one or more multi-component offers, the gaming system determines the award amount of the award component and the quantity of terminators of the termination component together (i.e., the two components form a predefined pair of components). In one such embodiment, the gaming system determines an award amount of the award component and a quantity of terminators of the termination component from a range of award amounts and quantities of terminators. In one such embodiment, for each multi-component offer, the gaming system randomly selects an award amount and a quantity of terminators from a weighted table of award amounts coupled with quantities of terminators. In one such embodiment, the gaming system utilizes the same range (or the same weighted table) for each of the rounds of the offer and acceptance game. In another such embodiment, the gaming system utilizes different ranges (or different weighted tables) for each of a plurality of the rounds of the offer and acceptance game.

In another embodiment, the gaming system provides the player a set quantity of offers over each of the rounds or levels of the offer and acceptance game. In this embodiment, the gaming system enables the player to use as many offers as they want on each round or level until they have exhausted their total quantity of offers. For example, if an offer and acceptance game includes four rounds or levels in which the gaming system provides the player with a total of ten offers and the player uses one offer on the first round or level, then the player is left with nine offers for the remaining three levels. In another such example of this offer and acceptance game, if the player uses five offers on the first round or level, then the player is left with five offers for the remaining three levels.

In another embodiment, rather than accumulating terminators with accepted or final offers (as described above), the gaming system causes the player to accumulate terminators with each offer regardless of if the player accepts or rejects the offer. For example, if the gaming system offers the player a multi-component offer of five-hundred credits and two terminators, the gaming system automatically accumulates one of the terminators regardless of if the player accepts or rejects the offer. In this example, if the player accepts the offer, the gaming system accumulates the second terminator and if the player rejects the offer, the gaming system does not accumulate the second terminator.

In another embodiment, the gaming system employs a plurality of different types or versions of terminators. In one embodiment, one or more multi-component offers each include a plurality of different types of terminators. In another embodiment, one or more multi-component offers each include one of the different types of terminators. In one embodiment, one or more different types of terminators are each associated with a separate termination threshold wherein the offer and acceptance game continues until the player reaches the final round or one of the termination thresholds for one of the terminators is reached. For example, the gaming system uses red terminators, blue terminators and yellow terminators wherein the gaming system enables the player to keep playing the offer and acceptance game so long as the player does not collect three terminators of the same color.

In one embodiment, as described above, the gaming system displays terminators to the player as separate items or icons. In another embodiment, the gaming system displays terminators to the player in association with displaying the award component of the multi-component offer. For example, the gaming system associates any award components displayed to the player in a red font with one or more terminators. In another example, the gaming system associates any award components including an odd number of credits with one or more terminators.

In one embodiment, the gaming system causes at least one display device of the player's gaming device to display the offer and acceptance game. In another embodiment, in addition or in alternative to each gaming device displaying the offer and acceptance game, the gaming system causes one or more community or overhead display devices to display part or all of the offer and acceptance game to one or more other players or bystanders either at a gaming establishment or viewing over a network, such as the internet. In another embodiment, in addition or in alternative to each gaming device displaying the offer and acceptance game, the gaming system causes one or more internet sites to each display the offer and acceptance game such that a player is enabled to log on from a personal web browser. In another such embodiment, the gaming system enables the player to play one or more primary games on one device while viewing the offer and acceptance game from another device. For example, the gaming system enables the player to play one or more primary games on a mobile phone while viewing the status of the offer and acceptance game on a desktop or laptop computer.

In another embodiment, as mentioned above, an offer and acceptance game triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes an offer and acceptance game triggering event to occur.

In another embodiment, as also mentioned above, the gaming system does not provide any apparent reasons to the players for an offer and acceptance game triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one embodiment, an offer and acceptance game triggering event occurs, based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, an offer and acceptance game triggering event occurs, based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the players primary game wager, determined based on time (such as the time of day) or determined based on any other suitable method or criteria.

In another alternative embodiment, an offer and acceptance game triggering event occurs, based on a predefined variable reaching a defined parameter threshold. For example, when the $500{,}000^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, an offer and acceptance game triggering event occurs, based on a quantity of games played. In this embodiment, a quantity of games played is set for when one or more of such events or conditions will occur. In one embodiment, such a set quantity of games played is based on historic data.

In another alternative embodiment, an offer and acceptance game triggering event occurs, based on time. In this embodiment, a time is set for when one or more of such events or conditions will occur. In one embodiment, such a set time is based on historic data.

In another alternative embodiment, an offer and acceptance game triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, an offer and acceptance game triggering event occurs, based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, an offer and acceptance game triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a progressive award contribution rate reconfiguration event to occur, and/or causing a progressive award triggering event to occur may be implemented in accordance with the gaming system and method disclosed herein.

It should be appreciated that any of the above-described offer and acceptance game triggering events may be combined in one or more different embodiments.

Alternative Embodiments

It should be appreciated that in different embodiments, one or more of:

i. when an offer and acceptance game triggering event occurs;
ii. a quantity of rounds or levels in the offer and acceptance game;
iii. a quantity of available offers for each round or level of the offer and acceptance game;
iv. a total quantity of available offers of the offer and acceptance game;
v. which components form each multi-component offers for each round or level of the offer and acceptance game;
vi. an amount or value of each award component of each multi-component offer for each round or level of the offer and acceptance game;

vii. a range of awards used to select an award of an award component of a multi-component offer;

viii. a weighted table of awards used to select an award of an award component of a multi-component offer;

ix. a type of award of each award component of each multi-component offer for each round or level of the offer and acceptance game;

x. a quantity of terminators of each termination component of each multi-component offer for each round or level of the offer and acceptance game;

xi. a range of quantities of terminators used to select a quantity of terminators of a termination component of a multi-component offer;

xii. a weighted table of quantities of terminators used to select a quantity of terminators of a termination component of a multi-component offer;

xiii. a type of terminators of each termination component of each multi-component offer for each round or level of the offer and acceptance game;

xiv. a quantity of terminators of the termination threshold of the offer and acceptance game;

xv. a quantity of terminators provided for each offer which the player may accept or reject; and xvi. any determination disclosed herein; is/are predetermined, randomly determined, randomly determined based on one or more weighted percentages, determined based on a generated symbol or symbol combination, determined based on a random determination by the central controller, determined based on a random determination at the gaming system, determined based on at least one play of at least one game, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (1) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
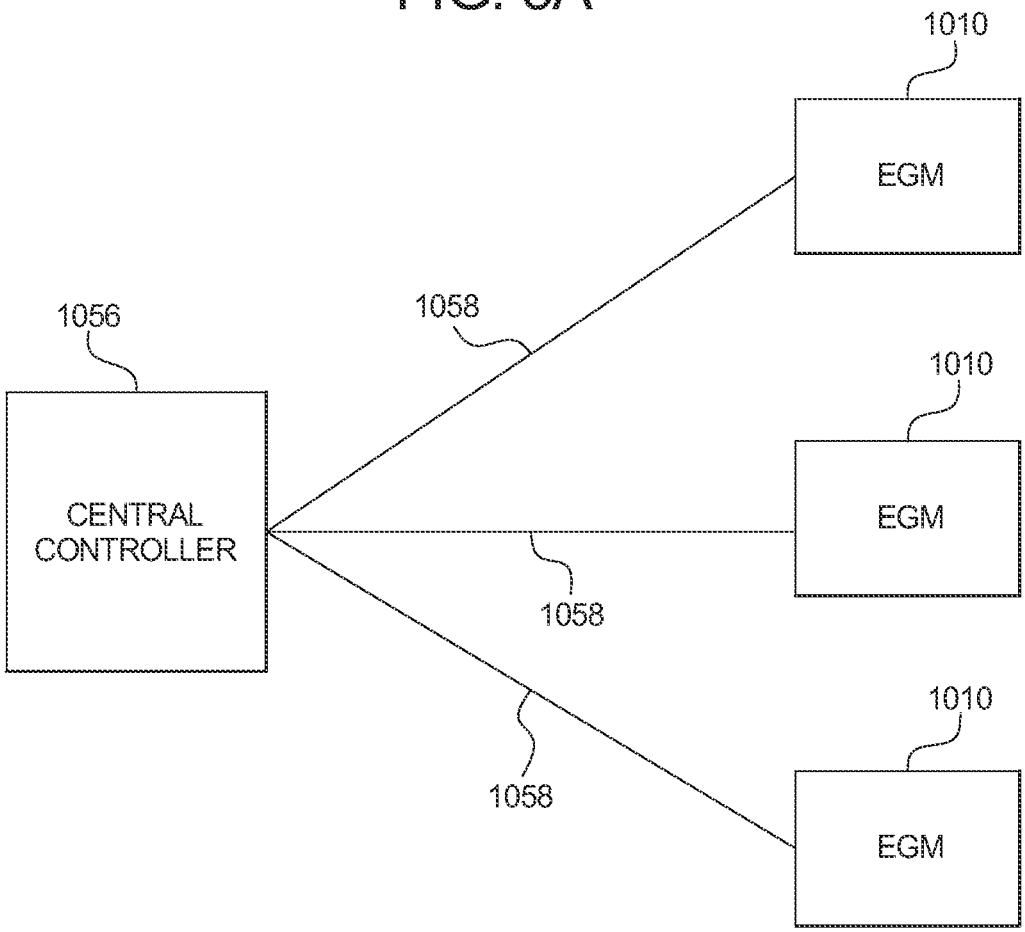
FIG. 5A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGA and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
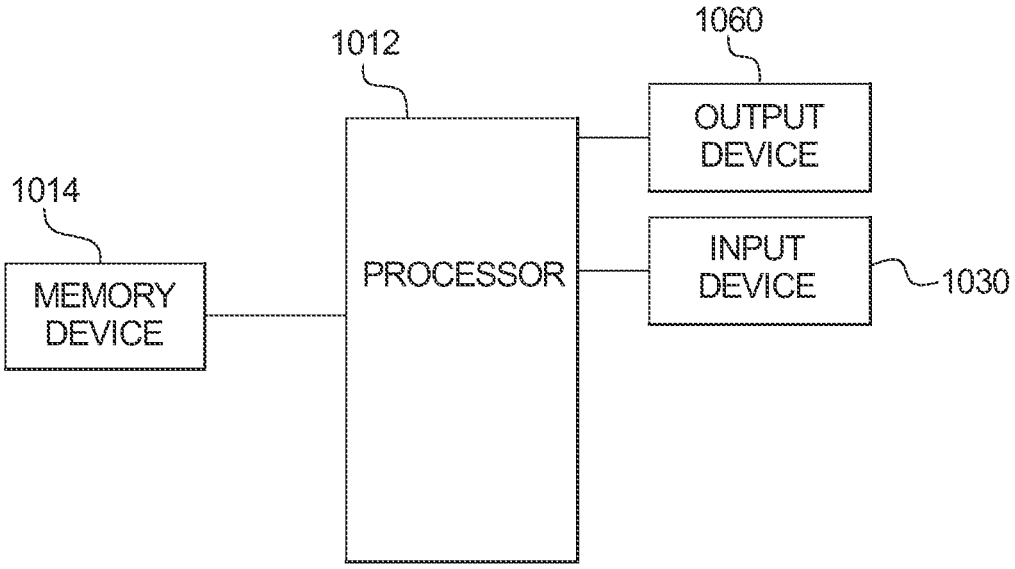
FIG. 5B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
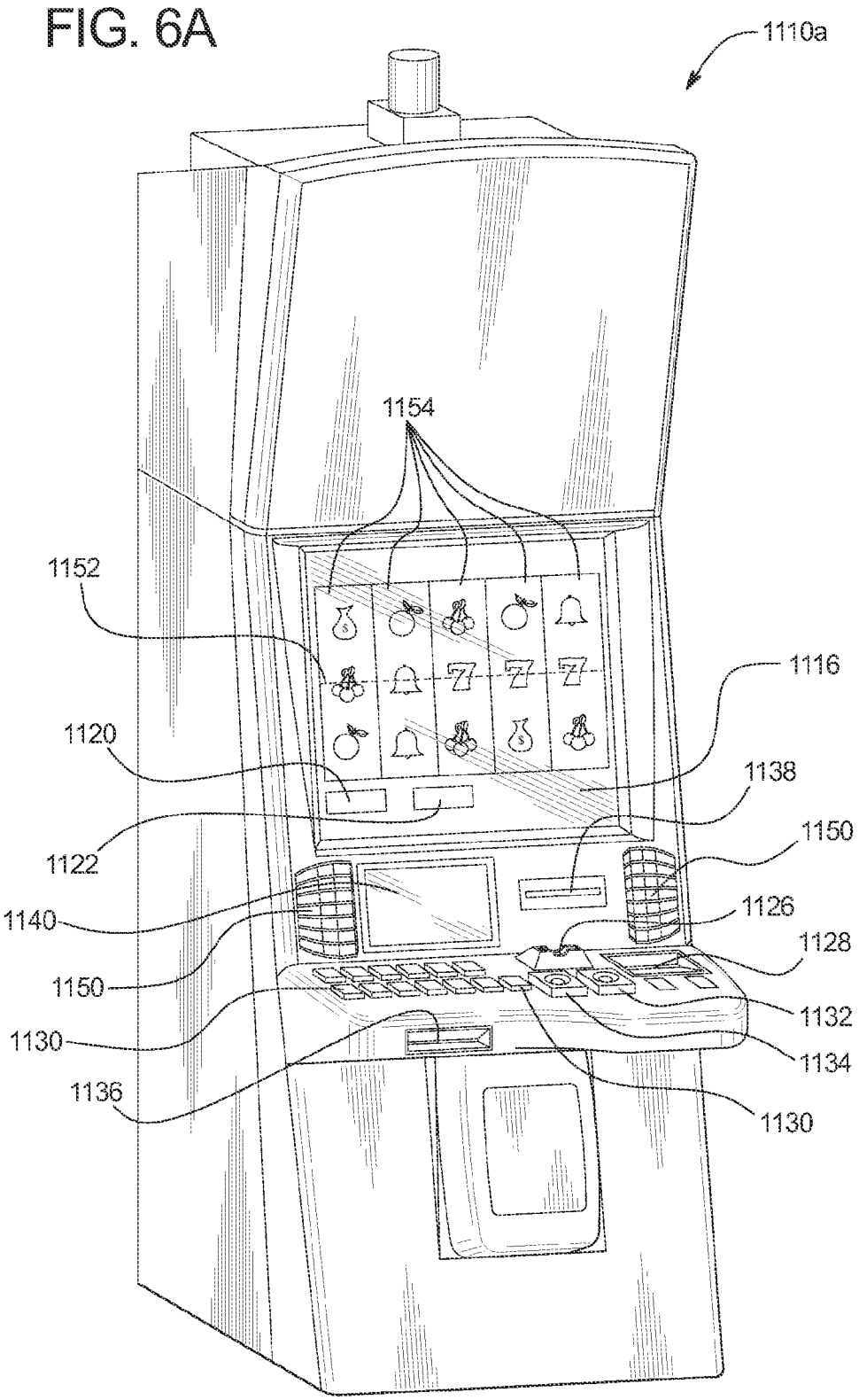
FIGS. 6A and 6B are perspective views of example alternative embodiments of the gaming system disclosed herein.
Figure 6B:
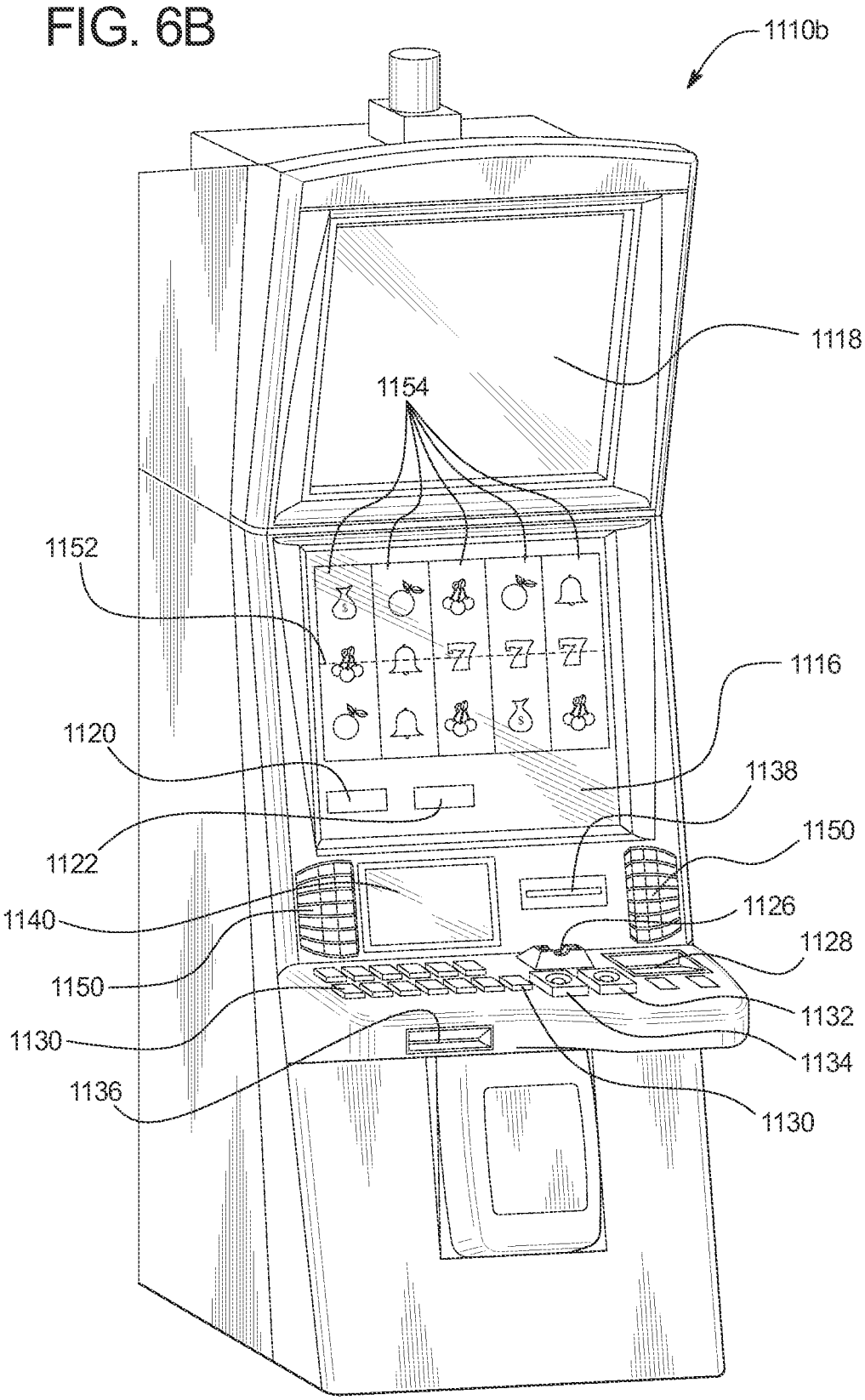

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 6A and 6B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the players anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including:

(i) an acceptor, (ii) a validator, and (iii) a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor:

(i) identify, via the validator, the received physical item, and (ii) establish a credit balance based, at least in part, on a monetary value associated with the received and identified physical item, (b) for an individual round of a plurality of individual rounds of a play of an offer and acceptance game:

(i) display, via the at least one display device, a multi-component offer including both a randomly determined award component and a distinct termination component, (ii) if the displayed multi-component offer is a final multi-component offer for said individual round of the offer and acceptance game:

(A) provide the award component of the final multi-component offer, and (B) determine, via the at least one processor, if the termination component of the final multi-component offer causes a termination condition to occur, and (iii) if the displayed multi-component offer is not the final multi-component offer for said individual round of the offer and acceptance game:

(A) receive an input to accept or reject the displayed multi-component offer, (B) if the input to accept the displayed multi-component offer is received:

(1) provide the award component of the multi-component offer, and (2) determine, via the at least one processor, if the termination component of the multi-component offer causes the termination condition to occur, and (C) if the input to reject the displayed multi-component offer is received, repeat (b)(i) to (b)(iii) at least once, (c) if the termination component of the accepted multi-component offer or the final multi-component offer does not cause the termination condition to occur, repeat (b)(i) to (b)(iii) for at least one individual subsequent round of the play of the offer and acceptance game, (d) if the termination component of the accepted multi-component offer or the final multi-component offer causes the termination condition to occur, not repeat (b)(i) to (b)(iii) for any individual subsequent rounds of the play of the offer and acceptance game, and (e) if a cashout input is received via the cashout device, cause an initiation of any payout associated with the credit balance.

2. The gaming system of claim 1, wherein the termination component includes a quantity of terminators.

3. The gaming system of claim 2, wherein an average expected quantity of terminators of the multi-component offers of one individual round of the offer and acceptance game is different than an average expected quantity of terminators of the multi-component offers of another individual round of the play of the offer and acceptance game.

4. The gaming system of claim 3, wherein an average expected value of the award components of the multi-component offers of one individual round of the offer and acceptance game is different than an average expected value of the award components of the multi-component offers of another individual round of the play of the offer and acceptance game.

5. The gaming system of claim 2, when executed by the at least one processor, the plurality of instructions cause the at least one processor to accumulate the quantity of terminators of each accepted multi-component offer and of each final multi-component offer.

6. The gaming system of claim 5, wherein when executed by the at least one processor, the plurality of instructions cause the at least one processor to accumulate the quantity of terminators of each multi-component offer which the input to accept or reject is received.

7. The gaming system of claim 6, wherein when executed by the at least one processor, the plurality of instructions cause the at least one processor to cause the termination condition to occur if a quantity of accumulated terminators reaches a termination threshold.

8. The gaming system of claim 1, wherein an individual quantity of multi-component offers is associated with each individual round.

9. The gaming system of claim 1, wherein a total quantity of multi-component offers is associated with each of the individual rounds.

10. The gaming system of claim 1, wherein the award component of each multi-component offer is selected from the group consisting of: a quantity of monetary credits, a quantity of non-monetary credits, a progressive award, a quantity of free spins of a game, a multiplier, and a multiplier of a quantity of free spins of a game.

11. A method of operating a gaming system, said method comprising:

(a) for an individual round of a plurality of individual rounds of a play of an offer and acceptance game:

(i) causing at least one display device to display a multi-component offer including both a randomly determined award component and a distinct termination component, (ii) if the displayed multi-component offer is a final multi-component offer for said individual round of the offer and acceptance game:

(A) providing the award component of the final multi-component offer, wherein a credit balance is increasable based on the award component of the final multi-component offer, and said credit balance is:

(I) increasable via:

(1) an acceptor of a physical item associated with a monetary value, and (2) a validator configured to identify the physical item, and (II) decreasable via a cashout device configured to receive an input to cause an initiation of a payout associated with the credit balance, and (B) causing at least one processor to execute a plurality of instructions to determine if the termination component of the final multi-component offer causes a termination condition to occur, and (iii) if the displayed multi-component offer is not the final multi-component offer for said individual round of the offer and acceptance game:

(A) receiving an input to accept or reject the displayed multi-component offer, (B) if the input to accept the displayed multi-component offer is received:

(1) providing the award component of the multi-component offer, wherein the credit balance is increasable based on the award component of the multi-component offer, and (2) causing the at least one processor to execute the plurality of instructions to determine if the termination component of the multi-component offer causes the termination condition to occur, and (C) if the input to reject the displayed multi-component offer is received, repeating (a)(i) to (a)(iii) at least once, (b) if the termination component of the accepted multi-component offer or the final multi-component offer does not cause the termination condition to occur, repeating (a)(i) to (a)(iii) for at least one subsequent individual round of the play of the offer and acceptance game, and (c) if the termination component of the accepted multi-component offer or the final multi-component offer causes the termination condition to occur, not repeating (a)(i) to (a)(iii) for any subsequent individual rounds of the play of the offer and acceptance game.

12. The method of claim 11, wherein the termination component includes a quantity of terminators.

13. The method of claim 12, wherein an average expected quantity of terminators of the multi-component offers of one individual round of the offer and acceptance game is different than an average expected quantity of terminators of the multi-component offers of another individual round of the play of the offer and acceptance game.

14. The method of claim 13, wherein an average expected value of the award components of the multi-component offers of one individual round of the offer and acceptance game is different than an average expected value of the award components of the multi-component offers of another individual round of the play of the offer and acceptance game.

15. The method of claim 12, which includes causing the at least one processor to execute the plurality of instructions to accumulate the quantity of terminators of each accepted multi-component offer and of each final multi-component offer.

16. The method of claim 15, which includes causing the at least one processor to execute the plurality of instructions to accumulate the quantity of terminators of each multi-component offer which the input to accept or reject is received.

17. The method of claim 16, which includes causing the at least one processor to execute the plurality of instructions to cause the termination condition to occur if a quantity of accumulated terminators reaches a termination threshold.

18. The method of claim 11, wherein an individual quantity of multi-component offers is associated with each individual round.

19. The method of claim 11, wherein a total quantity of multi-component offers is associated with each of the individual rounds.

20. The method of claim 11, wherein the award component of each multi-component offer is selected from the group consisting of: a quantity of monetary credits, a quantity of non-monetary credits, a progressive award, a quantity of free spins of a game, a multiplier, and a multiplier of a quantity of free spins of a game.

21. The method of claim 11, which is provided through a data network.

22. The method of claim 21, wherein the data network is an internet.

23. A non-transitory computer readable medium including a plurality of instructions, which when executed by at least one processor, cause the at least one processor to:

(a) for an individual round of a plurality of individual rounds of a play of an offer and acceptance game:
  (i) cause at least one display device to display a multi-component offer including both a randomly determined award component and a distinct termination component,
  (ii) if the displayed multi-component offer is a final multi-component offer for said individual round of the offer and acceptance game:
    (A) provide the award component of the final multi-component offer, wherein a credit balance is increasable based on the award component of the final multi-component offer, and said credit balance is:
      (I) increasable via:
        (1) an acceptor of a physical item associated with a monetary value, and
        (2) a validator configured to identify the physical item, and
      (II) decreasable via a cashout device configured to receive an input to cause an initiation of a payout associated with the credit balance, and
    (B) determine if the termination component of the final multi-component offer causes a termination condition to occur, and
  (iii) if the displayed multi-component offer is not the final multi-component offer for said individual round of the offer and acceptance game:
    (A) receive an input to accept or reject the displayed multi-component offer,
    (B) if the input to accept the displayed multi-component offer is received:
      (1) provide the award component of the multi-component offer, wherein the credit balance is increasable based on the award component of the multi-component offer, and
      (2) determine if the termination component of the multi-component offer causes the termination condition to occur, and
    (C) if the input to reject the displayed multi-component offer is received, repeat (a)(i) to (a)(iii) at least once, (b) if the termination component of the accepted multi-component offer or the final multi-component offer does not cause the termination condition to occur, repeat (a)(i) to (a)(iii) for at least one subsequent individual round of the play of the offer and acceptance game, and (c) if the termination component of the accepted multi-component offer or the final multi-component offer causes the termination condition to occur, not repeat (a)(i) to (a)(iii) for any subsequent individual rounds of the play of the offer and acceptance game.

24. The non-transitory computer readable medium of claim 23, wherein the termination component includes a quantity of terminators.

25. The non-transitory computer readable medium of claim 24, wherein an average expected quantity of terminators of the multi-component offers of one individual round of the offer and acceptance game is different than an average expected quantity of terminators of the multi-component offers of another individual round of the play of the offer and acceptance game.

26. The non-transitory computer readable medium of claim 25, wherein an average expected value of the award components of the multi-component offers of one individual round of the offer and acceptance game is different than an average expected value of the award components of the multi-component offers of another individual round of the play of the offer and acceptance game.

27. The non-transitory computer readable medium of claim 24, when executed by the at least one processor, the plurality of instructions cause the at least one processor to accumulate the quantity of terminators of each accepted multi-component offer and of each final multi-component offer.

28. The non-transitory computer readable medium of claim 27, wherein when executed by the at least one processor, the plurality of instructions cause the at least one processor to accumulate the quantity of terminators of each multi-component offer which the input to accept or reject is received.

29. The non-transitory computer readable medium of claim 28, wherein when executed by the at least one processor, the plurality of instructions cause the at least one processor to cause the termination condition to occur if a quantity of accumulated terminators reaches a termination threshold.

30. The non-transitory computer readable medium of claim 23, wherein an individual quantity of multi-component offers is associated with each individual round.

31. The non-transitory computer readable medium of claim 23, wherein a total quantity of multi-component offers is associated with each of the individual rounds.

32. The non-transitory computer readable medium of claim 23, wherein the award component of each multi-component offer is selected from the group consisting of: a quantity of monetary credits, a quantity of non-monetary credits, a progressive award, a quantity of free spins of a game, a multiplier, and a multiplier of a quantity of free spins of a game.

* * * * *